US011745536B2

(12) United States Patent
Bienvenu et al.

(10) Patent No.: US 11,745,536 B2
(45) Date of Patent: Sep. 5, 2023

(54) METHOD OF MANUFACTURING A WATCH COMPONENT

(71) Applicant: ROLEX SA, Geneva (CH)

(72) Inventors: Carine Bienvenu, Pringy (FR); Patrice Nagel, Geneva (CH); Quoc-Hien Nguyen, Geneva (CH); Alexandra Roulet, Geneva (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 16/567,198

(22) Filed: Sep. 11, 2019

(65) Prior Publication Data

US 2020/0086678 A1 Mar. 19, 2020

(30) Foreign Application Priority Data

Sep. 17, 2018 (EP) ..... 18194911

(51) Int. Cl.

| | |
|---|---|
| ***B44C 1/00*** | (2006.01) |
| ***A44C 27/00*** | (2006.01) |
| *G04B 37/00* | (2006.01) |
| *B44C 1/22* | (2006.01) |

(52) U.S. Cl.

CPC ..... *B44C 1/005* (2013.01); *A44C 27/003* (2013.01); *A44C 27/006* (2013.01); *B44C 1/221* (2013.01); *G04B 37/0058* (2013.01)

(58) Field of Classification Search

CPC ..... B44C 1/005; B44C 1/221; A44C 27/003; A44C 27/006; G04B 37/0058; G04B 19/12; G04B 19/103; B24B 1/00; B24C 1/00

See application file for complete search history.

(56) References Cited

U.S. PATENT DOCUMENTS

| | | | | |
|---|---|---|---|---|
| 2011/0103199 | A1 | 5/2011 | Winkler et al. | |
| 2014/0225786 | A1* | 8/2014 | Lyons | G01S 19/24 343/702 |
| 2020/0264566 | A1* | 8/2020 | Curchod | C23C 8/36 |
| 2021/0078351 | A1* | 3/2021 | Lazar | G09F 9/372 |

FOREIGN PATENT DOCUMENTS

EP 2 138 323 A1 12/2009

OTHER PUBLICATIONS

European Search Report and Written Opinion dated Feb. 21, 2019 issued in counterpart application No. EP18194911; w/ English machine translation (total 31 pages).

* cited by examiner

*Primary Examiner* — Moshe Wilensky
(74) *Attorney, Agent, or Firm* — WHDA, LLP

(57) ABSTRACT

Method of manufacturing a watch component (10) for a timepiece, wherein it comprises a first stage of manufacturing a watch component (10) comprising a first surface (1), in which there is arranged at least one recess (20), that is to say a surface recessed from the first surface (1), and wherein it comprises a second finishing stage the watch component, leading to a change in the surface condition, more particularly the roughness, more particularly measured by the parameters Ra and/or Str, and/or the gloss, of the first surface (1) but not of the at least one recess (20) or of a portion exclusively of this at least one recess (20).

15 Claims, 4 Drawing Sheets

METHOD OF MANUFACTURING A WATCH COMPONENT

This application claims priority of European patent application No. EP18194911.6 filed Sep. 17, 2018, the content of which is hereby incorporated by reference herein in its entirety.

The present invention concerns a method of manufacturing a watch component. The invention also relates to a watch component as such. Lastly, the invention also relates to a timepiece comprising a suchlike watch component.

STATE OF THE ART

It is known to produce watch components in various materials, of which in particular metals, metal alloys and technical ceramic. The visible surface of a suchlike component may exhibit a plurality of different appearances, depending on the one or more different stages of finishing that are chosen. The surface condition of this visible surface thus permits a particular, desired esthetic appearance to be achieved. A suchlike visible surface may exhibit reliefs in relation to a principal surface, which are recessed in relation to this principal surface, for example in the form of recesses, or conversely forming a protruding relief in relation to this principal surface.

The existing methods of manufacturing a watch component, in particular in ceramic, exhibit all or part of the following disadvantages:

- they comprise complex stages for forming the surface conditions of the finished watch component;
- in the case of watch components exhibiting reliefs, more particularly recessed reliefs, the existing methods are poorly adapted or are complicated for forming certain different surface conditions on the different surfaces of the different reliefs, for example requiring stages of masking certain parts;
- in the case of watch components comprising recessed surfaces, the existing methods do not permit certain particular surface condition results to be achieved on the different surfaces of the different reliefs.

The overall object of the invention is to propose an improved and simplified solution in order to form a watch component of attractive esthetic appearance, comprising recessed reliefs, and which does not comprise all or some of the disadvantages of the state of the art.

More specifically, an object of the invention is to propose a solution in order to form a watch component comprising a first surface exhibiting a surface condition that is different from that of a second surface, situated in a manner recessed from said first surface.

BRIEF DESCRIPTION OF THE INVENTION

In this respect, the invention is based on a method of manufacturing a watch component for a timepiece, wherein it comprises a first stage of manufacturing a watch component comprising a first surface, in which at least one recess, that is to say a surface recessed from the first surface, is arranged and wherein it comprises a second finishing stage in order to manufacture the watch component, leading to a change in the surface condition, more particularly the roughness, more particularly measured by the parameters Ra and/or Str, and/or the gloss of the first surface, but not of the at least one recess or of a portion exclusively of this at least one recess.

The at least on recess comprises a recess surface, or second surface, recessed relative to said first surface, uncovered at the time of operating the second finishing stage, said recess surface keeping a surface condition unchanged at the end of said second finishing stage, unchanged relative to its surface condition at the beginning of second finishing stage.

The invention is also based on a watch component comprising a first surface, in which at least one recess is arranged, wherein all or part of the first surface present a first surface condition produced by tribofinishing (vibratory barreling) and/or mechanical and chemical polishing and/or by tumbling (barrel finishing) and/or by trovalising (vibratory finishing) and/or by sandblasting and/or by microbead blasting and/or by wet jetting, different from the second surface condition, more particularly the roughness, more particularly measured by the parameters Ra and/or Str, and/or the gloss, of at least one portion of the at least one recess.

Lastly, the invention is also based on a timepiece, more particularly a watch, wherein it comprises a watch component as described previously.

The invention is more specifically defined by the claims.

BRIEF DESCRIPTION OF THE FIGURES

These objects, characterizing features and advantages of the invention are explained in detail in the following description of particular embodiments that are given by way of non-exhaustive examples in relation to the figures attached hereto, among which.

DESCRIPTION OF THE INVENTION

Figure 1A:
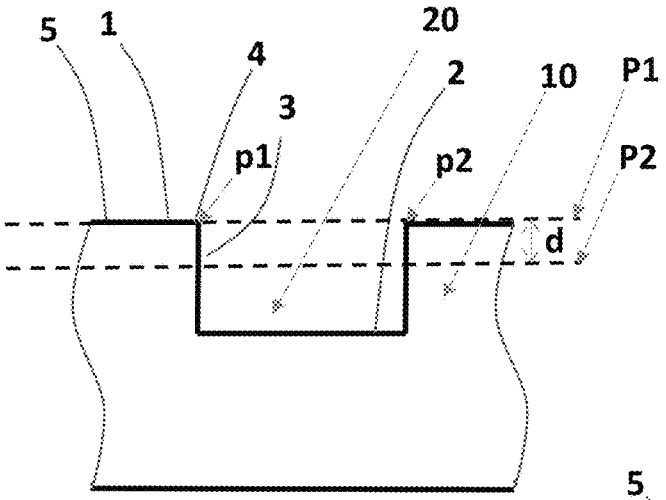
FIGS. 1*a* to 1*c* depict schematically a sectional view in the thickness of a watch component according to an embodiment of the invention.

In order to simplify the description, the same references are used to designate the same characterizing features or equivalent characterizing features in the different embodiments.

The invention concerns a watch component 10 of any chemical composition and in particular made of metal and/or of a metal alloy and/or of a technical ceramic. A suchlike component may thus be produced, for example, in stainless steel, in precious metals, in titanium, in alumina, in doped or undoped strontium aluminate, in stabilized or unstabilized zirconia, in organic-inorganic hybrid material or generally speaking in any metal alloy or in any technical ceramic or in any composite usable in the field of watchmaking. The expression "technical ceramic" is used to designate dense materials based on aluminum oxide, and/or zirconium oxide, and/or stabilized zirconium oxide, and/or nitrides, and/or carbides and/or strontium aluminate, especially doped strontium aluminate. The expression "dense" denotes a material of which the density is comprised between 95% and 100% of the theoretical density of the material in question. The expression "based on a certain composite" signifies that the material comprises, by weight, at least 50% of said composite. In order to simplify the description, the expression "ceramic" is used in order to designate the "technical ceramic".

The watch component 10 may be in a single piece or may comprise the combination of different parts assembled with one another. It may thus be of a single chemical nature or may be a combination of chemical natures. It may thus comprise the same material or a plurality of different materials. It may be in a single color or in a plurality of colors.

The invention further concerns any type of watch component. This watch component 10 may be a bezel or a bezel insert, but more generally any finishing element, a case, a back, a case middle, a dial, a decorative plate, or a link of a bracelet. This component may likewise be a component of the movement, such as a calendar date disk, for example.

The invention relates more specifically to a watch component 10 exhibiting at least one recessed relief defined by a recessed surface in relation to the principal surface 5 of the watch component, a suchlike recessed relief generally being referred to as a recess. The principal surface 5 is considered here to be the visible surface with the largest area of the watch component.

A second recessed surface 20 or recess 20 is more specifically formed in a first surface 1 of the watch component, which constitutes all or part of the principal surface 5. This recessed surface 20 is cut into the first surface 1; an edge 4 forms an interface between the first surface 1 and the recessed surface 20. This latter may be plane or curved. It may be frustoconical, for example. It may be continuous or discontinuous, moreover, that is to say it may be formed from a plurality of plane or curved surfaces connected by edges. The recess 20 may thus adopt any form. It may comprise more particularly at least one third surface 2 forming a bottom, which may be connected to the first surface 1 by a connecting surface 3. The third surface 2 and/or the connecting surface 3 may be continuous or discontinuous.

For example, the second recessed surface 20 or recess 20 may comprise a third surface 2 forming a bottom surface substantially parallel to the first surface 1, connected to the first surface by one or a plurality of lateral walls serving as a connecting surface 3 substantially perpendicular to the bottom, forming a niche with a flat bottom, as illustrated by the recess 20 in FIG. 1*a*. A suchlike bottom may, for example, feature a symbol or an alphanumerical character provided to display a time indication or an indication derived from the time or any marking of some kind.

Figure 1B:
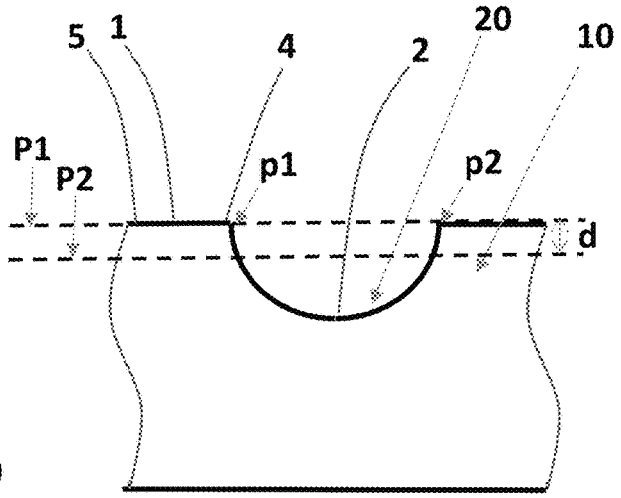

As a variant, the second recessed surface 20 or recess 20 may be present in the form of a curved surface comprising a rounded section forming a U, as illustrated by the recess 20 in FIG. 1*b*. In this particular variant, it is not possible to distinguish the bottom from the connecting surface. In such variant, it is considered that the third surface 2 comprises the connecting surface 3.

Figure 1C:
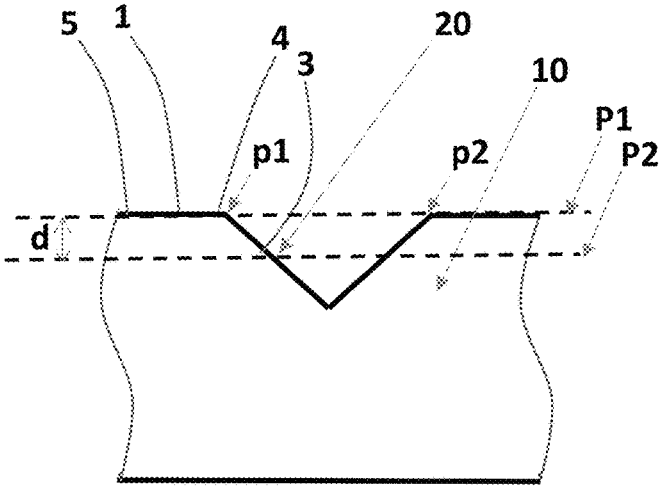

As a variant, the second recessed surface 20 or recess 20 may be in the form of a discontinuous surface comprising a section in the form of a V, as illustrated by the recess 20 in FIG. 1*c*.

As a variant (not depicted in the figures), the second recessed surface 20 or recess 20 may not include a bottom. In this case, the recess 20 is a through bore, that is to say it traverses the watch component 10 from one side to the other.

The invention concerns the method of manufacturing a suchlike watch component. This method comprises a first stage involving preparing a watch component 10 containing a principal surface 5 and a first surface 1 in which at least one recess 20 is arranged.

Since this element produced by the first stage exhibits substantially the final forms and dimensions of the watch component, it is already referred to as a watch component, even if it is not totally completed. It should be noted that this first stage is implemented in a known manner by any state-of-the-art method.

For esthetic reasons, a portion of the principal surface 5 may be exempted from processing according to the invention in such a way as to conserve its initial surface condition. In the invention, the first surface 1 is considered to be a surface in which at least one recess is arranged and which is involved in the rest of the method, that is to say its surface condition will be modified. This surface condition is characterized more particularly, in a non-limitative manner, by the roughness, particularly by means of standardized roughness parameters Ra and/or Str, and/or by the gloss, or by the color, as described in detail below on the basis of a plurality of examples.

For example, the first stage may involve the manufacture of a bezel insert made of ceramic or a metallic decorative plate, containing recesses.

The concept of the invention involves the implementation of a second finishing/termination stage, which enables the surface conditions of the watch component to be finalized, and more particularly which enables different surface conditions between the first and the second surface of the watch component to be produced easily. In order to do this, the second stage of the invention more specifically implements a finishing stage the watch component 10 leading to a change in the surface condition of the first surface, for example intended to reduce the specular reflection, without affecting or affecting to the least possible extent the at least one recess (that is to say the at least one recessed surface), or, as a side note, an exempted part, if any, of the principal surface.

The recessed surface 20 may be optionally affected by the second finishing stage at the level of the edge 4 forming an interface between the first surface 1 and said recessed surface 20. Taking into account a plane P1 passing through two points p1, p2 of an edge 4 forming two extremities of a section of a recess 20, and perpendicular to the sectional plane P of said section, the second finishing stage may for example affect a portion of said recess 20 or second recessed surface 20 which is comprised between the plane P1 and a plane P2 parallel to the plane P1 and remote by a distance d from the plane P1 in the direction of the interior of said recess, as depicted in FIGS. 1*a* to 1*c*. In other words, the surface condition of the recess may possibly be modified for a distance d strictly lower than the depth of the recess. The depth is measured in a direction perpendicular to the planes P1 and P2.

Preferably, the distance d does not exceed 80 μm, or 50 μm, or 20 μm. Of course, this distance may be zero.

A third surface 2 forming a bottom, such as that depicted in FIG. 1*a*, is not influenced by the second finishing stage. The connecting surface 3, such as that depicted in FIG. 1*a* or 1*c*, or a third surface 2 forming a bottom merged with the connecting surface 3, such as that depicted in FIG. 1*b*, may nevertheless be at least partially modified by the second finishing stage for a depth d.

Lastly, in all cases, at least one portion of the second recessed surface will retain an unchanged surface condition during this second finishing stage, as detailed below.

The expression "finishing stage" is understood to denote a change in the surface condition of the first surface 1 by interposed media. The distinguishing feature of this method of finishing is to enable a suchlike result to be achieved in the absence of any masking protecting the recesses, with media and abrasives known as "free"; the contact between the abrasives and the surface to be finished is performed by impacts and not by friction, as in the case of polishing. This stage comprises, for example, the mechanical action of an abrasive mixture by impacts, for example by setting in vibratory, oscillatory or rotary motion, for example inside a container (tribofinishing). It also comprises, for example in a non-exhaustive manner, barrel finishing, and/or trovalising, and/or sandblasting and/or microbead blasting and/or wet jetting of said first surface 1.

The finishing stage utilizes an abrasive which may be carried by media. In the case of the tribofinishing, the dimension and/or the geometry of the media is defined in such a way as to prevent all contact by the media with at least one deepest portion of the recess, namely a portion arranged below a plane P2 as defined previously, more particularly in such a way as to prevent all contact with a third surface 2 forming a bottom. The media may have a polyhedral form, more particularly pyramidal or spherical. They may be made of glass, ceramic, porcelain, steatite, alumina, or zircon ($ZrSiO_4$). In the case of sandblasting and/or microbead blasting and/or wet jetting, these are abrasive particles of which the dimension and/or the geometry are/is defined in such a way as to prevent all contact with at least one portion of the recess, more particularly with a third surface 2 forming a bottom.

The composition of the abrasive mixture may include at least the first of the following three components:

- media (also referred to as carriers or chips) disposed, for example, in a container, the role of which is to transfer the movement of the container to the abrasive mixture and to the watch components to be processed, in such a way as to generate mechanical actions which permit the abrasive effect to be produced on the watch component. The chemical nature, the geometry and the initial dimensions of the media are selected in order to achieve the desired result. The media may be abrasive. Likewise, the ageing and the wear of the media are monitored, in order to remain within tolerance limits;
- an abrasive in the form of a powder or paste, of which the role is to amplify the effect of the friction and the mechanical actions, and therefore the abrasive affect. The abrasive particles utilized in sandblasting and/or microbead blasting and/or wet jetting are considered to be an abrasive media;
- a liquid (for example water, or an oil, with or without an additive, or a mixture of liquids) which thins the mixture and limits the increase in temperature during the finishing operation. This may be optional, for example, in the case of sandblasting.

The composition of the abrasive mixture comprises media exhibiting the following characterizing features:

- a structure, more particularly the dimension and the geometry, which does not permit them to come into contact with at least one portion of a recess or of a recessed surface, and preferably with the integrality of the third surface 2 forming a bottom. For example, the media have a geometry and a dimension adapted in such a way as to be likely to come into contact with the edges 4 at the interface between the first surface 1 and a recess, at the top of at least one recess, in order not to touch more particularly the third surface 2 of said recess;
- a mass and a chemical composition permitting tribofinishing without chipping of the edges of the recess;
- a material composition that is subject to parameters permitting the media to wear uniformly in the course of tribofinishing (and more particularly not to break down). For this purpose, as mentioned previously, the media may, for example, be made more particularly of glass, ceramic, porcelain, steatite, alumina or zircon ($ZrSiO_4$).

The method of manufacturing a watch component 10 for a timepiece may comprise an intermediate stage between the two stages mentioned above, involving changing the surface condition of all or part of the principal surface 5 and possibly of the second recessed surface 20 with the intention of maximizing the specular reflection. This modification may form surfaces of homogeneous and isotropic topography. For example, this stage may correspond to polishing of the surfaces with the intention of making them glossy. The second finishing stage changes the surface condition of the first surface 1 in such a way as to impart to it a homogeneous and isotropic topography having reduced specular reflection. In this case, this finishing stage is a stage of matification of the first previously polished surface 1. A suchlike approach also makes it possible to produce a watch component 10 comprising a first matt surface 1, and a second recessed surface 20 of which the surface condition is at least partially unchanged. A suchlike approach more particularly makes it possible to produce a watch component 10 that is able to comprise a first matt surface 1, and a third surface 2 forming a bottom surface of which the surface condition is unchanged.

The second finishing stage thus changes the surface condition of all or part of the principal surface 5 in order to impart a homogeneous and isotropic topography to the first surface 1, while reducing, or minimizing its specular reflection.

The first stage of manufacturing a watch component 10 may be followed by an intermediate stage, as a stage of deposition of a coating in the at least one recess or recessed surface, more particularly the third surface 2, as a monolayer or multi-layer coating, more particularly a stage of deposition by PVD ("Physical Vapor Deposition"), by CVD ("Chemical Vapor Deposition"), by ALD ("Atomic Layer Deposition"), by LBL ("Layer by Layer"), by ink-jet, by dip-coating, by brush, by dispenser, by spraying, by nebulization or by the sol-gel method. For this purpose, the deposition is first performed, for example, on the whole component and is then removed from the first surface 1, for example during the intermediate stage as described above. A suchlike coating may comprise a layer of metal (metals) and/or of oxide(s) and/or of nitride(s) and/or of carbide(s) and/or of nitrocarbide(s) and/or of sulfide(s) and/or of organic material(s), and/or of inorganic material(s), and/or of hybrid material(s), and/or of a paint, and/or a lacquer, and/or an enamel, and/or a varnish and/or of a vitroceramic, and/or a polymer-based or adhesive-based material.

Figure 4:
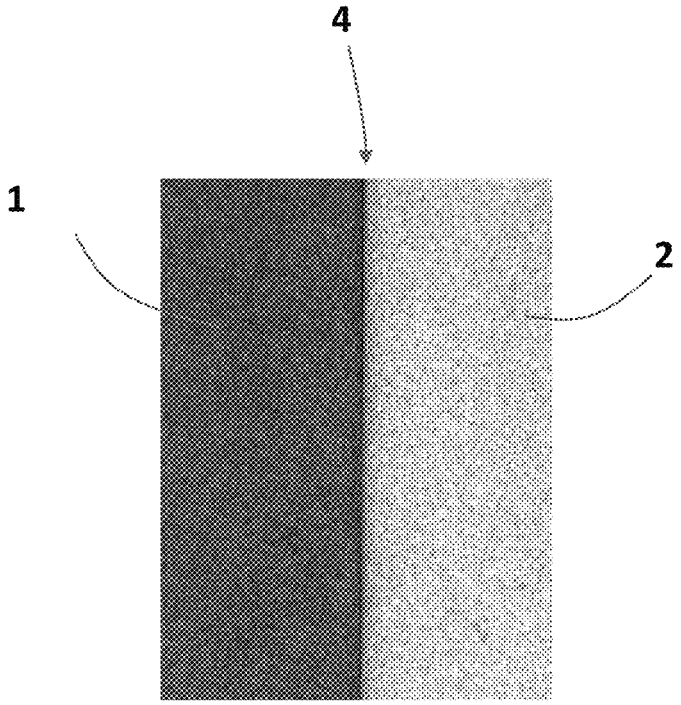
FIG. 4 is a photograph of a watch component manufactured according to an embodiment of the invention.

FIG. 4 is a photograph of a watch component 10 taken at the level of the interface between the first surface 1 and the third surface 2 of a recess, corresponding to an example comprising a recess according to FIG. 1*a*, as detailed below.

The method may comprise a complementary stage after the second finishing stage, for example a stage of diamond-cutting, in order to make a portion of the principal surface glossy, more particularly the first surface 1, for example a part forming a bevel. Accordingly, the second finishing stage is not necessarily the final stage of the method of manufacturing.

As a complement to the first example of a watch component 10 containing only a single type of recess, as illustrated in FIGS. 1*a* to 1*c*, the watch component 10 may comprise at least one second type of recess of any other geometry and/or a multitude of recesses, of the same geometry or otherwise, interleaved one in the other or otherwise. Their structures represent different embodiments.

Figure 2:
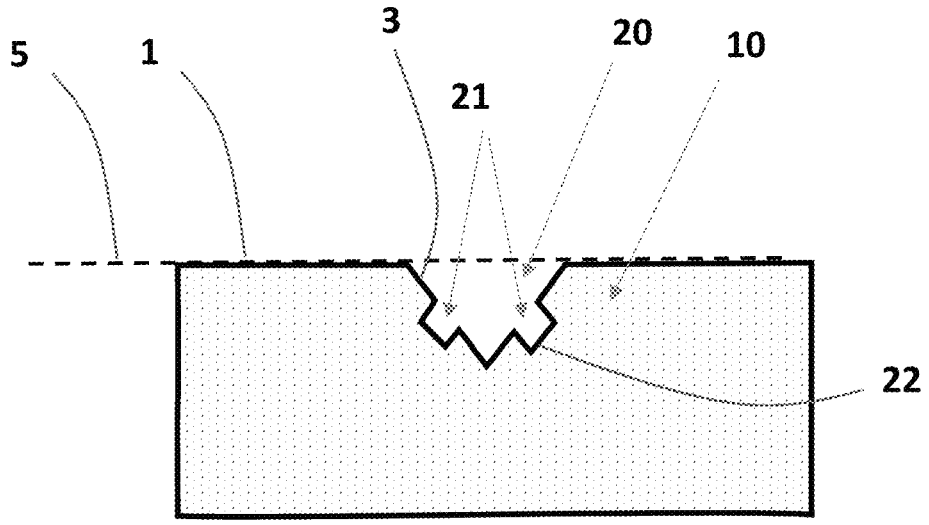
FIG. 2 depict schematically a sectional view in the thickness of a watch component according to a first variant of the embodiment of the invention.

FIG. 2 illustrates by way of example a watch component 10 according to a variant embodiment. This watch component 10 comprises a first surface plane 1, in which a hollow relief is present. This hollow relief is constituted by a recess 20 or by a second recessed surface 20 comprising a connecting surface 3, which itself comprises second recesses 21 or fourth recessed surfaces 21, each comprising a fifth surface 22 forming a bottom. The first recess 20 is of V-shaped form, as in the example depicted in FIG. 1*c*, and the second recesses 21 inserted into the connecting surface of the first recess 20 exhibit a niche-shaped form, as in the example depicted in FIG. 1*a*. In this variant embodiment, the second finishing stage is selected in order to change only the surface condition of the first surface 1: accordingly, this stage does not change the surface condition of the recessed surfaces 20 and 21.

As a variant, the surface condition of a portion of the second recessed surface 20, comprised between planes P1 and P2 as defined previously, may similarly be affected by the second finishing stage, without the recesses or the fourth recessed surfaces 21 being affected.

Figure 3:
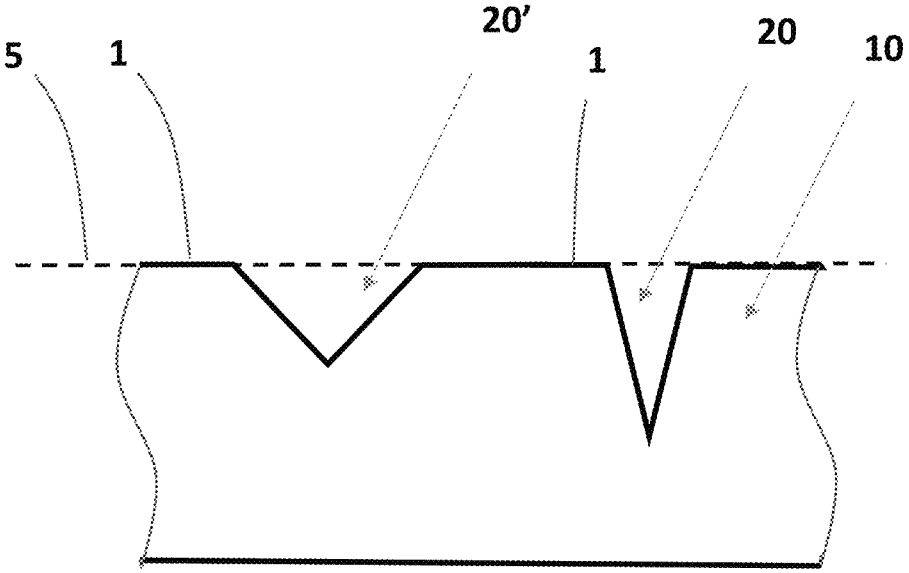
FIG. 3 depict schematically a sectional view in the thickness of a watch component according to a second variant of the embodiment of the invention.

FIG. 3 illustrates by way of example a watch component 10 according to another particular illustrative embodiment. This watch component 10 comprises a principal surface 5, in which two recesses 20 and 20' are present, in different zones forming a first, possibly discontinuous surface 1 between the two recesses. The second recess 20' is wider than the first recess 20, although less deep. In this variant embodiment, the recess 20' is accessible to the media. Each recess 20, 20' is configured as defined above with reference to FIG. 1*c*. The finishing stage thus changes the surface condition of the first surface 1 and of the second recess 20' without affecting the first recess 20.

The invention is now illustrated on the basis of a number of examples, in a non-restrictive manner.

In a first illustrative embodiment, the watch component 10 made of ceramic, more specifically of yttriated zirconia, is a bezel insert. It exhibits a frustoconical principal surface 5, more particularly a frustoconical first surface 1, in which recesses or recessed surfaces are realized in the form of niches comprising third surfaces, each forming a bottom 2, as well as vertical or substantially vertical connection surfaces of 3 ensuring the connection between the first surface 1 and the third surfaces, each forming a bottom. The recesses exhibit a section of rectangular form, a width of 0.69±0.05 mm and a depth 0.15±0.05 mm. The bezel insert already exhibits its final geometry together with the recesses.

After the first stage of the method of manufacturing, an intermediate stage comprising the following sub-stages:

- optionally, sandblasting and/or microbead blasting and/or wet jetting on the whole of the disk;
- the deposition of a metallic coating by PVD on the entirety of the disk;
- polishing, which selectively suppresses the coating of the first surface 1, but not of the recesses, and which permits a homogeneous and isotropic topography to be achieved at the level of the first surface 1, maximizing the specular reflection of this first surface 1. This stage of polishing corresponds to the intermediate stage described above.

The method of manufacturing then comprises a second finishing stage by tribofinishing, corresponding to a stage of matification of the first surface 1. For this purpose, the utilized equipment is a centrifuge machine with satellites which include a one-liter bowl, into which the components to be tribofinished are placed loosely together with:

- 750 g of media (carriers) (glass balls having a diameter of 5 mm);
- 20 g of detergent;
- 20 g of abrasive (boron carbide powder of a grade comprised between 3 and 5 μm);
- 300 g of water.

The rotation is adjusted to 300 revolutions/min for different durations.

In this first illustrative embodiment, the surface condition of the first surface 1 ahead of the second stage of tribofinishing (roughness R1) is polished, and that of the third surface 2 forming the bottom of a recess before the stage of tribofinishing (roughness R2) is sandblasted. After the stage of tribofinishing, the respective roughnesses of the first surface 1 and of the third surface 2 forming the bottom of a recess become "R1'" and "R2'". These roughness values according to this first illustrative embodiment are summarized in the following table, which details the roughness values Ra and their differences, expressed in nanometers, as well as the Str, as well as the gloss measured with a glossmeter and expressed in gloss units and the color expressed in the CIELab space color.

The results of characterization of the first surface 1 before finishing "1", of the surface 1 after finishing "1'", of the third surface 2 before finishing "2", and of the third surface 2 after finishing "2" are also included.

| | 1 | 1' | 2 | 2' |
|---|---|---|---|---|
| Roughness Ra in nm | R1 = 2.0 ± 0.2 | R1' = 200 ± 20 | R2 = 370 ± 50 | R2' = 370 ± 50 |
| Roughness Str | / | $Str_{1'}$ = 0.89 ± 0.03 | $Str_2$ = 0.64 | $Str_{2'}$ = 0.64 |
| Gloss [GU] | 182.8 ± 0.36 | 18.9 ± 0.54 | Not measured | Not measured |
| Color SCI | $L_1$* = 44.70 ± 0.02<br>$a_1$* = −0.02 ± 0.00<br>$b_1$* = −0.72 ± 0.00 | $L_{1'}$* = 38.79 ± 0.05<br>$a_{1'}$* = −0.04 ± 0.01<br>$b_{1'}$* = −0.84 ± 0.03 | Not measured | Not measured |
| Color SCE | $L_1$* = 0.00 ± 0.00<br>$a_1$* = 0.02 ± 0.01<br>$b_1$* = 0.01 ± 0.00 | $L_{1'}$* = 37.68 ± 0.05<br>$a_{1'}$* = −0.09 ± 0.01<br>$b_{1'}$* = −0.90 ± 0.04 | Not measured | Not measured |

It should be noted that the parameters S (Sa, Sdr, Sq, . . . ) are taken from standard ISO 25178 and are not filtered. The parameters R (Ra, Rp, Rz, . . . ) are taken from standard ISO 4287 and have been filtered with a gaussian filter, of which the cut-off is set at 0.25 mm. More specifically, the parameters selected for the analysis of the roughness are:

1) For the granular surface:
   a. Parameter Ra (ISO 4287) representing the mean height (arithmetical) of the roughness.
   b. Parameter Str (ISO 25178) representing the degree of isotropy of the surface. The value of this parameter is comprised between 0 and 1, close to 0 signifying that the surface comprises a preferred direction, whereas close to 1, all the directions of observation are identical.
2) For the smooth surface, only the parameter Ra is used and represents the mean height (arithmetical) of the roughness.

Because of their technical definitions, these parameters are determined under specific conditions of measurement:

1) For the granular surface:
   a. Parameter Ra: It is necessary to utilize measurement equipment with a minimum vertical resolution of 2 nm and lateral resolution of 0.26 μm. The cut-off (Xc) of the selected standard ISO 4287 is 0.25 mm, which implies a length of evaluation in the order of 1.4 mm. The measurement is performed on a number of profiles greater than 1000. The delivered value of the parameter corresponds to the mean produced for the entirety of the profiles.
   b. Parameter Str: It is necessary to utilize measurement equipment with a vertical resolution of 2 nm minimum and a lateral resolution of 0.26 μm. The measurement is performed on 5 square zones having the same number of lines and columns (>1000). Suppression of polynomial form (in the order of 4) as well as thresholding (comprised between 0.5% and 99.5%) are performed on the measurements. The delivered value corresponds to the mean of the 5 measurements.
2) For the smooth surface, the calculation of the parameter Ra requires the use of measurement equipment with a vertical resolution of 0.2 nm minimum and a lateral resolution of 0.26 μm. The selected cut-off (Xc) of standard ISO 4287 is 0.25 mm, which involves a length of evaluation in the order of 1.4 mm. The measurement is performed on a number of profiles greater than 1000. The value of the delivered parameter corresponds to the mean performed on the entirety of the profiles.

FIG. 4 depicts a photograph of a part of the watch component 10 produced, viewed from above at the level of the interface between the first surface and the third surface 2 of a recess. The view from above makes it possible to observe the first surface 1 and the third surface 2 as well as the position of the edge 4. The connecting surface is not visible. The first surface 1 is in the form of a matified ceramic, and the third surface 2 is in the form of a sandblasted ceramic covered by a PVD coating.

Figure 5:
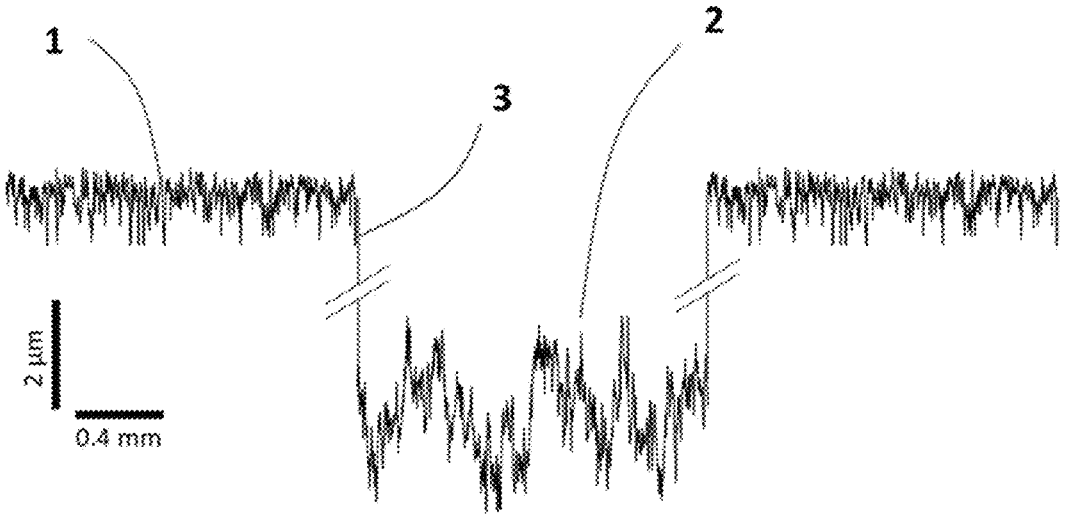
FIG. 5 depicts a raw linear profile of the roughness of the watch component in FIG. 4.

FIG. 5 depicts the linear profile of roughness at the level of the interface depicted in FIG. 4. It allows the difference in roughness between the third surface 2, or the bottom of the recesses and the first surface 1 to be established.

In a second illustrative embodiment, a watch component 10 made of ceramic, more specifically yttriated zirconia, is a decorative plate. It exhibits a first plane surface 1, in which there are produced recesses in the form of niches forming second recessed surfaces of the first surface 1, comprising surfaces of vertical or substantially vertical connection ensuring the connection between the first surface 1 and the third surfaces 2, each forming a bottom. Polishing is applied to the first surface 1 and the third surfaces 2 at the end of the first stage. A second stage of tribofinishing similar to that described in the first example is then applied.

The measurements of roughness Ra and their differences, expressed in nanometers, are described in more detail by the following table, as well as the gloss measured with a glossmeter and expressed in gloss units and the color expressed in the CIELab color space.

| | 1 | 1' | 2 | 2' |
|---|---|---|---|---|
| Roughness Ra in nm | R1 = 2.0 ± 0.2 | R1' = 200 ± 20 | R2 = 1.2 ± 0.1 | R2' = 1.5 ± 0.1 |
| Gloss [GU] | 182.8 ± 0.36 | 18.9 ± 0.54 | 182.8 ± 0.36 | 182.8 ± 0.36 |
| Color SCI | $L_1^* = 44.70 \pm 0.02$<br>$a_1^* = -0.02 \pm 0.00$<br>$b_1^* = -0.72 \pm 0.00$ | $L_{1'}^* = 38.79 \pm 0.05$<br>$a_{1'}^* = -0.04 \pm 0.01$<br>$b_{1'}^* = -0.84 \pm 0.03$ | Not measured | Not measured |
| Color SCE | $L_1^* = 0.00 \pm 0.00$<br>$a_1^* = 0.02 \pm 0.01$<br>$b_1^* = 0.01 \pm 0.00$ | $L_{1'}^* = 37.68 \pm 0.05$<br>$a_{1'}^* = -0.09 \pm 0.01$<br>$b_{1'}^* = -0.90 \pm 0.04$ | Not measured | Not measured |

The variation in the surface condition by means of the method of finishing described may be accompanied by a change in color. A black ceramic may become dark gray, or a green ceramic may become dark green, for example.

Figure 6:
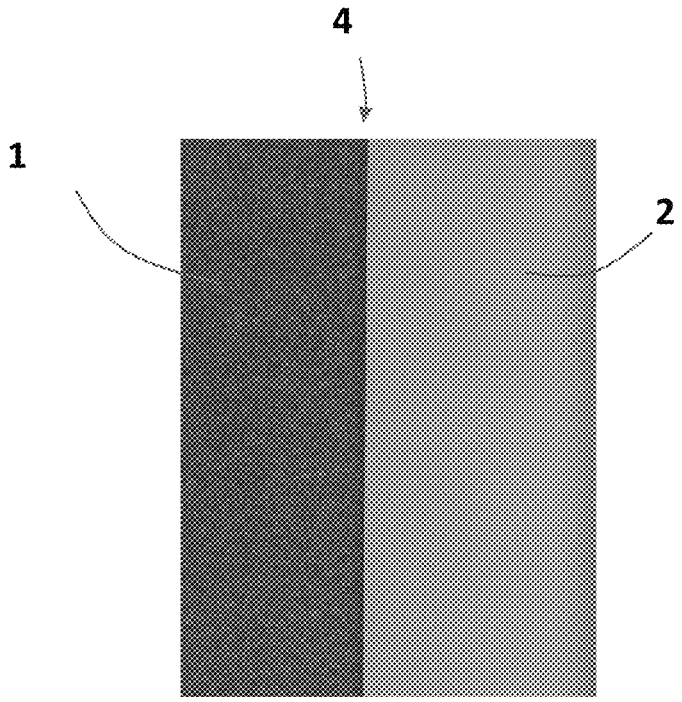
FIG. 6 is a photograph of another watch component manufactured according to an embodiment of the invention.

FIG. 6 depicts a photograph of a part of the watch component 10 produced, at the level of the interface between the first surface 1 and the third surface 2 of a recess. The view from above permits the first surface 1 and the third surface 2 of a recess as well as the position of the edge 4 to be observed. The connecting surface is not visible. The first surface 1 is in the form of a matt ceramic, and the third surface 2 is in the form of a polished ceramic.

Figure 7:
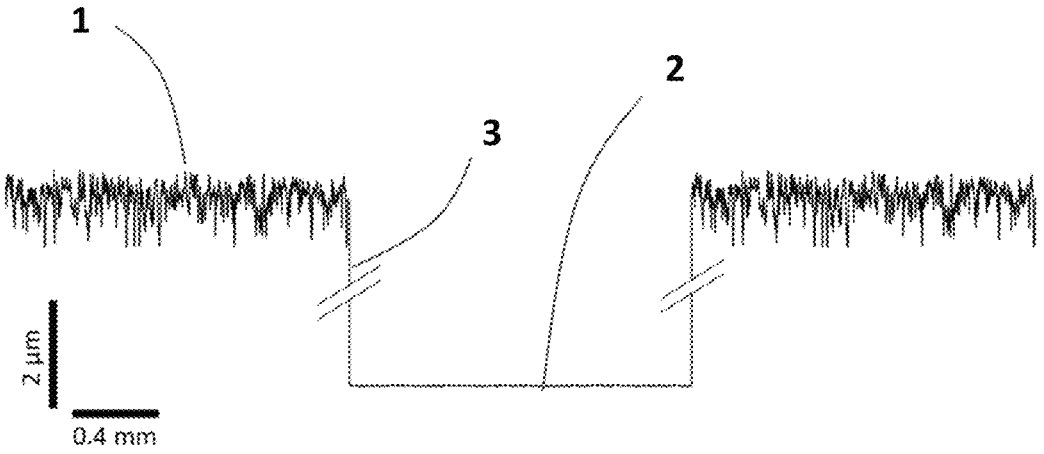
FIG. 7 depicts a raw linear profile of the roughness of the watch component in FIG. 6.

FIG. 7 depicts the linear roughness profile of at the level of the interface depicted in FIG. 6. It makes it possible to establish the difference in roughness between the third polished surface 2 forming the bottom of the recesses and the first matt surface 1.

Finally, it can be appreciated from this that the invention permits different surface conditions to be obtained easily, among which are a first uniformly terminated surface 1 and a polished or rough third surface 2 forming the bottom of the recess.

The invention also relates to a watch component 10 as such produced by the method described previously. This watch component 10 may be, for example, a bezel, a bezel insert, a finishing element, a case, a back, a case middle, a dial, a link of a bracelet or a decorative plate. This component may likewise be a component of the movement, for example a calendar date disk.

The watch component 10 thus comprises a first surface 1, in which at least one recess forming at least one second surface disposed recessed from the first surface 1, is arranged. This at least one second surface comprises, for example, a third surface 2 forming a bottom surface of recess, and a connecting surface situated between the first surface 1 and the third surface 2. The first surface 1 presents a first surface condition produced by finishing without having to protect the recesses when the media and/or abrasives are set in motion in the direction of the recesses, this first surface condition being different from the second surface condition of at least one portion of the at least one recess.

The watch component 10 may comprise a first surface 1 uniformly matified by tribofinishing and a polished or rough surface of a recess.

In addition, the component may comprise:

- a plurality of recesses of identical or different forms; and/or
- a plurality of recesses of different surface conditions.

In addition:

- the first surface 1 of the component may be matt, or may comprise matt and glossy zones; and/or
- the surface of a recess may comprise a coating; and/or
- the roughness of the first surface 1 may be lower than the roughness of at least one portion of the recess or the roughness, of the first surface 1 may be greater than the roughness of the recess; and/or
- the roughness of the first surface 1 may be homogeneous and isotropic, for example comprised between 100 nm and 10 μm (roughness Ra), or between 100 nm and 800 nm.

The invention also relates to a timepiece as such, more particularly a watch, more specifically a wristwatch.

Of course, the proposed finishing processes may be applied to any type of initial surface condition, either rough or prepared. By way of example, these surface conditions may be of the directional type, including one of the following:

- satin-finishing, brushing,
- circular-graining,
- snailing,
- circular-graining of different kinds: CEil de Perdrix (partridge eye pattern), spotting, . . .
- sunray-finishing.

According to other examples, these surface conditions may be of the isotropic type, on the other hand. Some of these propose a maximized specular reflection, such as polishing, or a minimized specular reflection, including one of the following:

- microbead blasting,
- graining,
- sandblasting,
- shotblasting.

For example, a bezel insert, which is a watch component 10 produced according to an embodiment of the invention. This bezel insert comprises a principal surface 5, for example bicolor, comprising at least one polished zone 6 and at least one matified zone 7. In order to obtain a suchlike result, the polished disk may be protected with a mask (for example a rigid mask made of metal) in a zone 6 during the second stage of tribofinishing (in this case matification from a polished surface condition). The recesses 20 form indications, for example round, around the periphery of the bezel insert. These recesses possess a coating enabling them to exhibit a predefined, clear and legible color. The surface condition of these recesses is identical, irrespective of their position within the at least one matt zone or the at least one glossy zone of the principal surface 5 of the bezel insert.

It is interesting to note that, in all cases, the finishing stage is undertaken in the presence of a recess in the surface concerned, that is to say in the presence of a recessed relief in the first surface which is treated in the finishing stage. Thus, even in the case of a coating that is produced in the recess, this coating is of low thickness and does not occupy the entire height of the recess, such that there always remains a recess forming a recessed relief in the surface. This recess is present before the start of the finishing stage, and also after this finishing stage.

It should be noted, therefore, that this finishing stage may not be compared to polishing, which would eliminate a surplus of material in order to form a continuous surface of a watch component without a relief, and thus without a recess. In fact, in such a case, not only the final component would no longer have a recess, that is to say no longer a recessed relief, unlike the intended object, but the surface condition would itself be continuous, since the surface in its entirety would be treated unavoidably in an identical manner by such polishing.

In all embodiments, the recess consists in a recessed relief portion, arranged on a first surface. The recess surface, or second surface, is understood as its top surface, that is oriented on the side of said first surface. It is placed at a lower level than said first surface since the recess forms a recessed relief, and is not covered by any other material, leading towards outside of the component, at least at the time of operating the second finishing stage. During such second finishing stage, at least a part, preferably the part of higher depth, keeps a surface condition unchanged.

Of course, the numerous embodiments and variants described previously may be combined.

The invention claimed is:

1. Method of manufacturing a watch component for a timepiece, the method comprising:

manufacturing a first watch component comprising a first surface, at least one recess being arranged in the first surface, the recess comprising a surface recessed from the first surface, and performing a finishing operation on the first watch component in order to manufacture the watch component, leading to a change in surface condition, and/or gloss of the first surface but not of at least a portion of the at least one recess, wherein the finishing operation utilizes an abrasive mixture comprising media having a dimension and/or a geometry defined so as to prevent all contact by the media with at least one portion of the recess, or wherein the finishing operation utilizes an abrasive mixture comprising media having a dimension and/or a geometry defined so as to prevent all contact by the media with a portion of the recess positioned at a distance greater than a given distance d.

2. Method of manufacturing a watch component for a timepiece as claimed in claim 1, wherein the finishing operation changes the surface condition of the first surface by subjecting the first surface to at least one of the following treatments:

- mechanical action of an abrasive mixture by impacts,
- tribofinishing,
- mechanical and chemical polishing,
- barrel finishing, trovalising,
sandblasting,
microbead blasting,
wet jetting.

3. Method of manufacturing a watch component for a timepiece as claimed claim 1, wherein:

the manufacturing of the first watch component forms a second recess in the at least one recess, the finishing operation leading to a change exclusively in the surface condition of the first surface; or the manufacturing of the first watch component forms a second recess in the at least one recess, the finishing operation leading to a change in surface condition of the first surface and of at least one portion of the at least one recess, but not of the second recess; or the manufacturing of the first watch component forms a second recess in the first surface, the second recess having a different geometry than the first recess, the finishing operation leading to a change in the surface condition of the first surface, but not of the first and second recesses; or the manufacturing of the first watch component forms a second recess in the first surface, the second recess having a different geometry than the first recess, the finishing operation leading to a change in the surface condition of the first surface and of the second recess, but not of at least a portion of the first recess.

4. Method of manufacturing a watch component for a timepiece as claimed in claim 1, wherein the manufacturing of the first watch component comprises:

manufacturing a ceramic-based homogeneous and single-piece component, or combining at least partially different parts made of ceramic.

5. Method of manufacturing a watch component for a timepiece as claimed in claim 1, wherein the manufacturing of the first watch component comprises coating the at least one recess in a mono-layer or multi-layer fashion.

6. Method of manufacturing a watch component for a timepiece as claimed in claim 5, wherein the coating comprises a layer composed of a material selected from the group consisting of metals, oxides, nitrides, carbides, nitrocarbides, sulfides, organic materials, inorganic materials, hybrid materials, paints, lacquers, enamels, varnishes, vitroceramics, polymer-based materials, and adhesive-based materials.

7. Method of manufacturing a watch component for a timepiece as claimed in claim 1, wherein the change in surface condition includes a change in roughness and/or gloss.

8. Method of manufacturing a watch component for a timepiece as claimed claim 1, wherein the manufacturing of the first watch component comprises coating a bottom surface of the at least one recess in a mono-layer or multi-layer fashion.

9. Method of manufacturing a watch component for a timepiece as claimed in claim 1, wherein the recess surface of the at least one recess is uncovered at a time of performing the finishing operation, and the recess surface maintains a surface condition unchanged at the end of the finishing operation.

10. Method of manufacturing a watch component for a timepiece as claimed in claim 1, wherein the finishing operation leads to a change in a surface condition of sides of the recess over the distance d strictly lower than a depth of the recess.

11. Method of manufacturing a watch component for a timepiece as claimed in claim 1, wherein:

the recess surface of the at least one recess is uncovered at a time of performing the finishing operation, and the recess surface maintains a surface condition unchanged at the end of the finishing operation, and/or the at least one recess comprises a third surface forming a bottom surface connected to the first surface by a connecting surface, the surface condition of the third surface of the at least one recess keeping a surface condition unchanged at the end of the finishing operation.

12. Method of manufacturing a watch component for a timepiece as claimed in claim 1, wherein the first watch component comprises a portion based on ceramic, the recess being located in the portion based on ceramic.

13. Method of manufacturing a watch component for a timepiece as claimed in claim 1, wherein the finishing operation changes the surface condition of the first surface by reducing or minimizing its specular reflection.

14. Method of manufacturing a watch component for a timepiece as claimed in claim 13, wherein the finishing operation changes the surface condition of the first surface so that the first surface has homogeneous and isotropic topography.

15. Method of manufacturing a watch component for a timepiece as claimed in claim 1, wherein the method comprises an intermediate operation involving changing a surface condition of at least a portion of a principal surface of the first watch component or of the first surface by increasing or maximizing the specular reflection thereof.

* * * * *